United States Patent [19]

Weis et al.

[11] Patent Number: 4,688,586

[45] **Date of Patent: * Aug. 25, 1987**

[54] CONVEYOR APPARATUS FOR CASTINGS IN A CLEANING DEVICE

[75] Inventors: Martin Weis, Ettlingen; Adolf Scholz, Karlsruhe, both of Fed. Rep. of Germany

[73] Assignee: BMD Badische Maschinenfabrik Durlach GmbH, Fed. Rep. of Germany

[ * ] Notice: The portion of the term of this patent subsequent to Feb. 26, 2002 has been disclaimed.

[21] Appl. No.: 583,435

[22] Filed: Feb. 24, 1984

[30] Foreign Application Priority Data

Feb. 26, 1983 [DE] Fed. Rep. of Germany ..... 3306857

[51] Int. Cl.[4] ..... B08B 5/02

[52] U.S. Cl. ..... 134/80; 134/134; 294/86.4; 294/902; 414/225; 414/226; 164/404

[58] Field of Search ..... 134/62, 63, 80, 134, 134/101; 198/650, 653; 414/225, 222, 226, 144 A; 164/269, 404; 294/86.4

[56] References Cited

U.S. PATENT DOCUMENTS

| | | | |
|---|---|---|---|
| 837,559 | 12/1906 | Graham | 134/157 |
| 1,494,436 | 5/1924 | Lormor | 198/653 X |
| 1,578,816 | 3/1926 | Eifried | 294/3 |
| 2,078,848 | 4/1937 | Greger | 294/86.4 |
| 2,319,501 | 5/1943 | Gora | 134/161 X |
| 2,780,229 | 2/1957 | Davis | 134/161 X |
| 2,926,675 | 3/1960 | Evans | 134/161 X |
| 2,991,791 | 7/1961 | Rozenfeld | 134/161 X |
| 3,370,879 | 2/1968 | Green et al. | 294/86.4 |
| 3,382,844 | 5/1968 | Kumpf | 134/134 X |
| 3,391,678 | 7/1968 | Lester et al. | 134/80 X |
| 3,885,825 | 5/1975 | Amberg et al. | 198/653 X |
| 3,967,946 | 7/1976 | Campbell | 294/87.1 |
| 4,062,437 | 12/1977 | Knapp | 134/161 X |
| 4,448,405 | 5/1984 | Cipolla | 294/86.4 X |
| 4,456,293 | 6/1984 | Panissidi | 294/86.4 X |
| 4,501,313 | 2/1985 | Weis et al. | 164/404 |

FOREIGN PATENT DOCUMENTS

| | | | |
|---|---|---|---|
| 233219 | 3/1910 | Fed. Rep. of Germany | 134/161 |
| 296674 | 3/1969 | Fed. Rep. of Germany | 134/62 |

*Primary Examiner*—Harvey C. Hornsby
*Assistant Examiner*—Frankie L. Stinson

[57] ABSTRACT

In a conveying apparatus for castings in a cleaning device, there are tooth-type casting holders which rotate about a horizontal or slightly inclined axis and comprise two gripping parts of which the upper part serves as a tension member for tensioning the casting piece, while the lower stationary gripping part is comprised of two or more supports for the casting that promote the cleaning operation by means of a revolving movement. The supports are positioned at an angle to the axis of rotation and are spaced by substantially equal distances at both sides. These supports hold the casting in a corresponding angular position relative to the axis of rotation. The upper gripping part can comprise one or more pendulously supported beams which, in the tensioning position, transmit tensioning or securing forces to the casting. In this respect, the tooth-type casting holder performs not only a transportation and rotational movement, but also can transmit to the casting a vibratory movement by means of a roller of a vibrator. The tooth-type casting holder includes a bearing ring rotatably symmetric about the axis of rotation and by means of which the rollers of the vibrator are rotated during the rotational movement.

17 Claims, 5 Drawing Figures

CONVEYOR APPARATUS FOR CASTINGS IN A CLEANING DEVICE

The invention relates to a conveying apparatus for castings in a cleaning device having at least one tong-like casting holder that rotates about a horizontal or slightly inclined axis with two gripping parts. The lower gripping part serves as a support for at least one casting piece and the upper part serves as a tension member for securing the casting.

Conveyor apparatuses with such tong-like casting holders are known, for example, from German Pat. No. 25 10 827 and a German Patent publication No. 26 13 717. These conveyor apparatuses are used above all for cleaning individual, large castings, such as motor blocks and the like, which consist of a number of cut-outs, cavities, notches, etc., and as a result of these, they must be sprayed on all sides and below from many angles in order to effectively loosen and remove sand casting residue. On account of this, such castings must be moved not only in a single movement direction through a cleaning device, but must also be extensively exposed to the cleaning jets through additional rotations of the casting holder. At the same time the rotational movements permit the loosened sand residue to fall from the pieces and to expose inaccessible positions to the cleaning jets. Also, it is thereby guaranteed that the spent jet medium cannot settle in the notches, cavities, and so on.

Nevertheless, the operative angles of such cleaning devices with castings, having deep cavities and angled contours, are ineffective so that either long cleaning times are required or additional manual finishing work must be performed afterward.

It is a principal object of the present invention to provide an improved conveying apparatus of the type described above in which castings with deep cavities and complex configurations can be jet cleaned effectively and in a comparatively shorter time, without the necessary manual finishing work.

Departing from the above described conveying apparatus, the inventive objects are attained by means of a lower gripping part having two or more supports for at least the one casting, and the supports for the casting have an angular position relative to the axis of rotation.

While in the known conveying apparatuses the castings extend in a direction of one of the axes, usually the longitudinal axis, and are held in this position by the tong-like casting holders; in accordance with the embodiment of the present invention, the castings assume a position tilted relative to the axis of rotation, so that they produce a type of revolving motion with the rotation of the tong-like holders. As a result of this, they are exposed to the cleaning jets at a constantly varying angle. The supports can be formed with a point shape, a line shape, or possibly a specially designed shape. Through the tilted positioning a further advantage is achieved in that two larger castings can be simultaneously supported by a single holder, whereby they are positioned with the longitudinal axes parallel to the tilted orientation. In comparison to conventional devices in which the castings are supported in the direction of their longitudinal axes, two castings can be simultaneously jet cleaned with approximately the same load on the tong-like supports. In one embodiment of the invention, this is accomplished by a lower gripping part that consists of at least two additional and possibly specially shaped supports, which are positioned at the same angle and with approximately the same distance from one another as the first two, preferably likewise specially shaped supports at both sides of the axis of rotation, yet they are set at a distance from the free end of the gripping part. The castings are supported therefore in positions parallel to one another and at the same tilt relative to the axis of rotation.

The above mentioned embodiment offers the possibility that one support of a first pair located on one side of the axis of rotation can be formed as a single piece with a support of another pair positioned on the other side of the axis of rotation. The embodiment of the supports and the lower gripping parts formed in this manner is particularly simple.

In accordance with a further object of the invention, the upper gripping part is comprised of at least one pendulously hung beam to which the tension forces on the casting are transmitted in the tension position of the casting holder. Preferably, this beam extends to the opposite side of the axis of rotation at an angle which corresponds approximately to the adjustment angle of the support of the lower gripping part on the other side of the axis of rotation. Further, the beam is advantageously positioned approximately intermediate each of the two supports.

This novel embodiment guarantees that a casting will be gripped at at least two spaced points along the beam and will be tensioned between the upper and lower gripping parts quite independently of the configuration of the upper contour of the casting. By positioning the pendulously hung beam intermediate the two lower supports, a type of three-point suspension of the casting is further guaranteed.

If the lower gripping parts are comprised by two pairs of supports for two castings, then a pendulously hung beam is advantageously positioned on the upper gripping part for each pair of supports on the lower gripping part. In this manner the aforementioned advantage is retained for each casting. This embodiment is, nevertheless, advantageously modified to a further extent so that the two beams are pendulously hung at the ends of a common beam which, in turn, is pendulously hung from the upper gripping part. With this, for example, it is guaranteed that during swinging movement of the upper gripping parts, both castings in the tension position will be firmly secured independently of the angular position. Also, with this embodiment, significant differences between the two castings can be balanced without simultaneously injuring the tension forces.

In a preferred embodiment, the supports and/or the beams on which sides the castings rest are formed like a comb, the teeth of which are advantageously taper down to blunt ends.

With this embodiment, the surfaces of the castings shielded from the cleaning jet by the supports are limited to as small a mass as possible, so that the cleaning jet strikes the casting substantially unhindered on its entire outer surface. This embodiment further causes the loosened mold sand and the spent jet material to fall free in an unimpeded manner.

If the casting cleaning apparatus employs a vibrating apparatus in addition to the jet apparatus in order to accelerate the cleaning process or to better rid the casting of loosened molding sand and jet material that deposits in deep cavities, then, according to the present invention, provisions are made so that the vibrator apparatus comprises a roller or a sliding surface and the tooth-type casting holder consists of a rolling surface which rolls on the pulley or sliding surface during the rotational movement.

By means of this rotation of the tooth-type casting support and the simultaneous vibration, all of the cavities and notches will be effectively cleaned of loose molding sand or accumulated jet material independently of the positioning or orientation.

The rolling surface can be formed, for example, as a rotatably symmetric race for rotation of the tooth-type casting holder, the race surrounding the supporting parts of the casting holder at a distance, and being supported from the supporting structure of the casting holder by struts. Instead of this, or in addition thereto, the race can also be secured by struts to the lower gripping parts. The diameter of the race must--according to the location of its mounting--be dimensioned so that it allows sufficient room for the then existing opening width of the tooth-type casting holder.

According to a further embodiment, the lower gripping part, which in general is stationary, and the struts of the race are fastened to a common support plate, which is connected with the supporting structure of the toothed holders through the intermediary of vibration dampers. Thereby, the parts of the casting holder that perform the holding function and which transmit the vibratory movements are vibrationally isolated from the supporting structure with the operating apparatus and the rotating drive of the casting holder.

The same purpose is served by the further measure that the pendulous supports of the beam, or correspondingly the common beam, are vibrationally damped relative to the upper gripping parts which, in general, accomplish the opening movement of the tooth-type casting holder.

Further features and advantages of the invention will be apparent from the following description of a preferred embodiment illustrated in the drawings. In the drawings.

Figure 1:
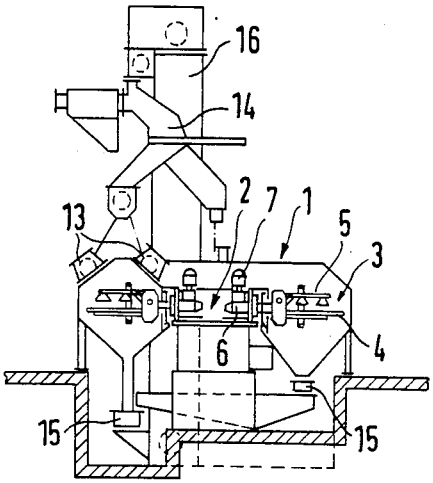
FIG. 1 is a schematic view through a casting cleaning device with a carousel-type rotation.
Figure 2:
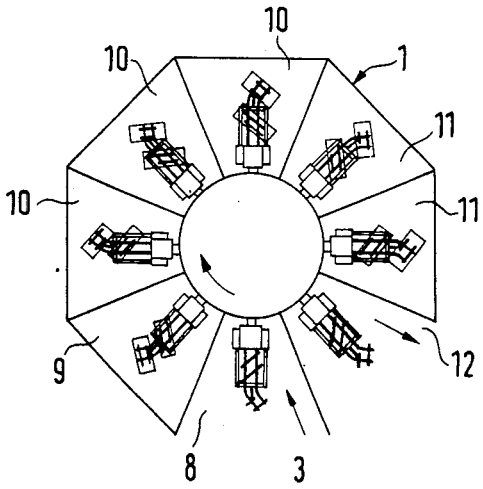
FIG. 2 is a schematic plan view of the interior of a cleaning compartment.

The casting cleaning apparatus, according to FIGS. 1 and 2, comprises a circularly shaped, closed cleaning compartment 1 within which the rotational drive is positioned in the form of a carousel 2 for rotation about a vertical axis. The carousel serves to rotate a plurality of tooth-type casting holders 3, which are formed with fixed lower gripping part 4, and a moveable upper gripping part 5. Additionally, each casting holder comprises a tensioning actuator 6, lying within the carousel for the upper gripping parts 5, and a rotational drive 7, by means of which the tooth-type casting holder is driven rotationally about a horizontal axis.

The cleaning compartment 1 has a plurality of chambers and corresponding stations, which are more clearly shown in Fig. 2. The first station 8 is formed as a loading station where the casting pieces to be cleaned are delivered to be loaded into a toothed support located in a preparatory position. The next station 9 serves, for example, as a sluice and shields the following jet stations from the surrounding area. The last jet station 10 is followed by two stations 11 in which the jet material still remaining on the castings generally and in the cavities in particular is drained. Accordingly, the last station 11 is formed as a sluice as well. This is then followed by station 12 lying adjacent to loading station 8 for unloading the castings.

In the region of the jet station 10, fan blowers 13 are positioned in the ceiling of the cleaning cabin 1, and these blowers direct the jet materials from a distributor 14. The spent jet materials exit from the cleaning cabin 1 at the lower side and arrive again at the distributor 14 from an elevator 16 by means of a conveyor 15 and a screening device which separates the molding sand from the jet material.

At the discharging station 11 of the cleaning cabin 1 vibrator devices can be positioned if necessary and can be provided with pulleys on which the rotating tooth-type casting piece holders 3 lie and roll during their rotational movement.

Figure 3:
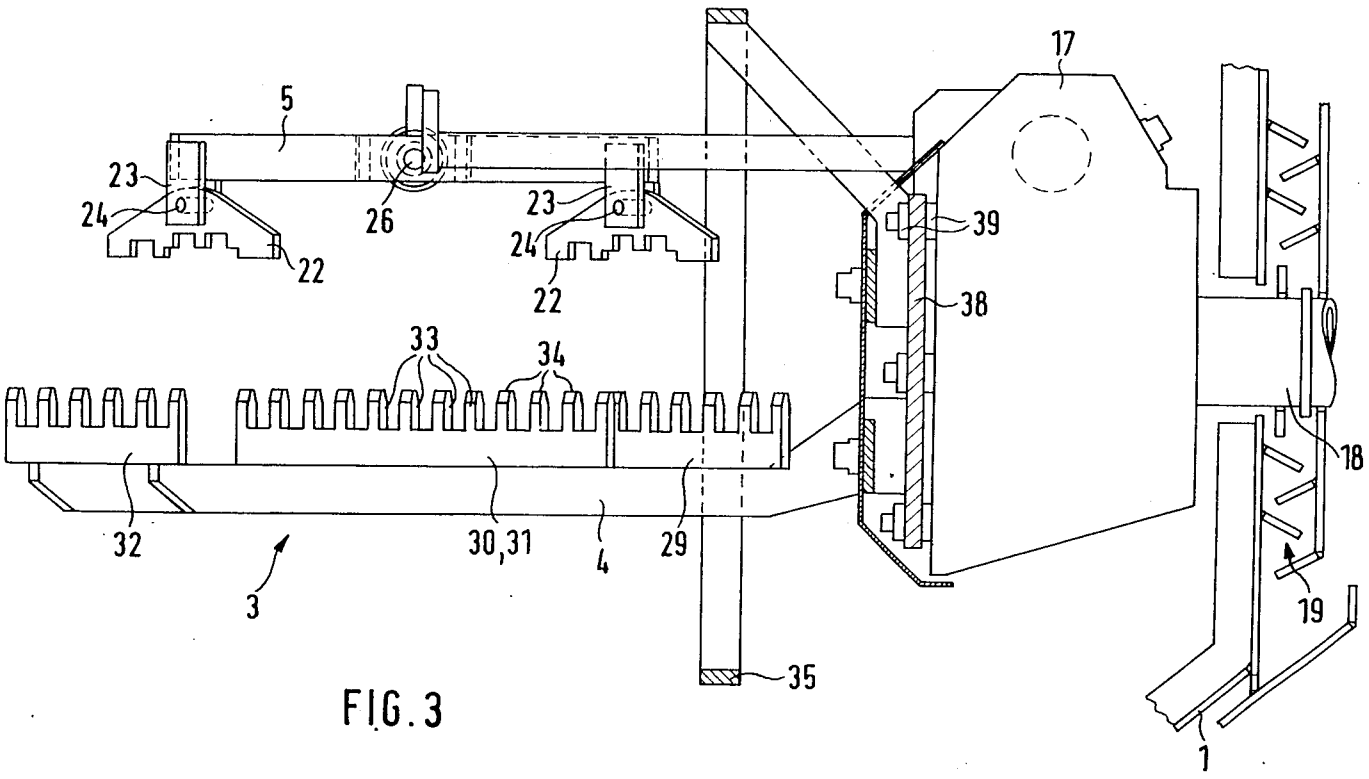
FIG. 3 is a side elevation view of the tooth-type casting support.
Figure 4:
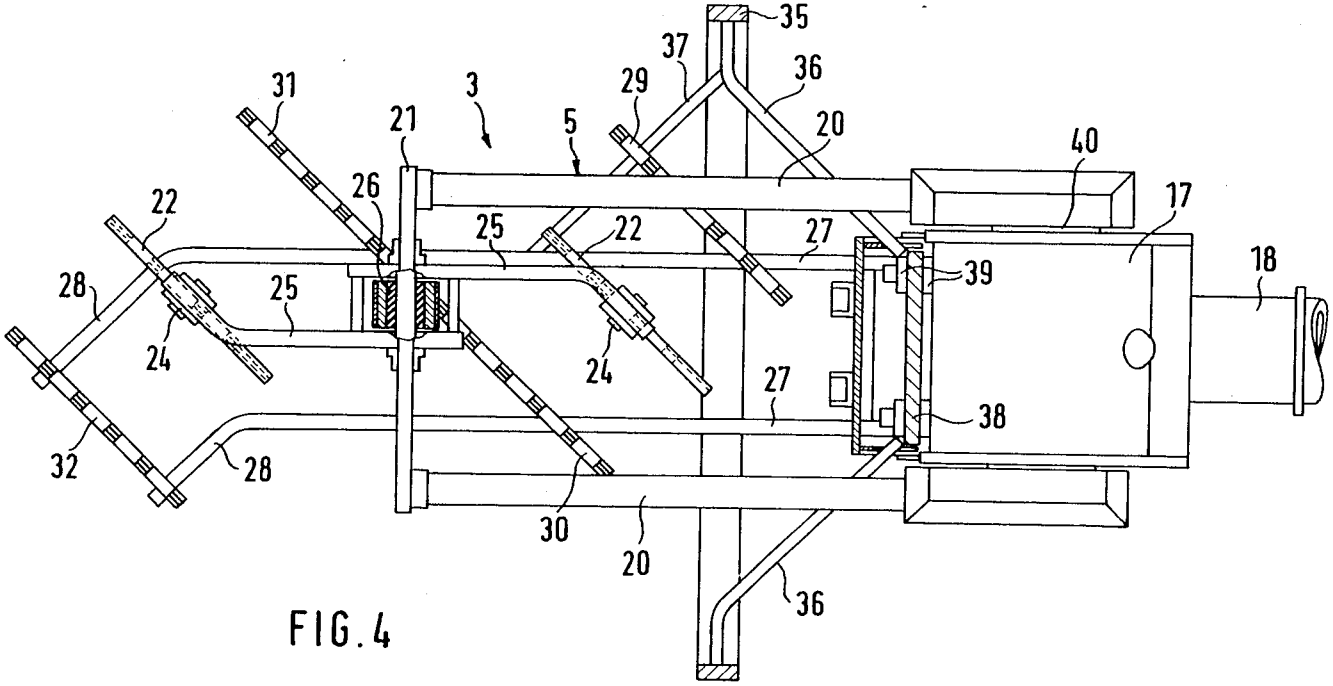
FIG. 4 is a top plan view of the casting support according to FIG. 1.
Figure 5:
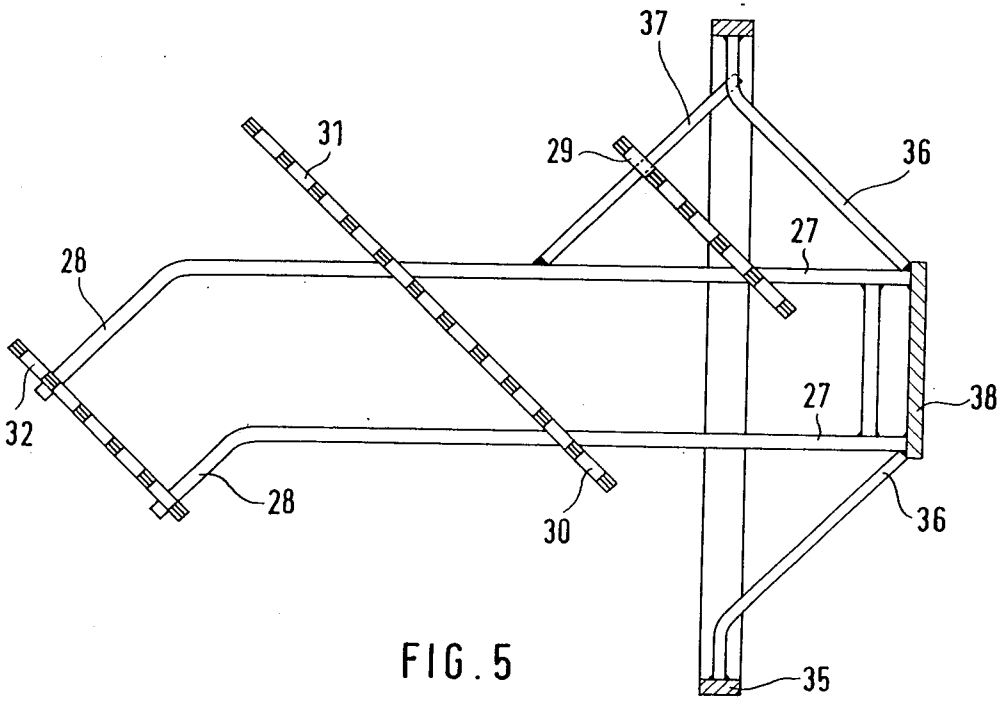
FIG. 5 is a top view similar to FIG. 4 of the lower gripping parts of the tooth-type casting holder.

In FIGS. 3–5, the tooth-type casting piece holders are illustrated in greater detail. Each holder comprises, as was already indicated, a lower stationary gripping part 4 and an upper gripping part 5 that provide tension. These sit on a housing-type support structure 17, which is driven by a shaft 18 leading through the wall of the cleaning cabin 1. A labyrinth seal 19 is positioned at the point where the shaft 18 penetrates through the wall of the cabin 1, and the seal prevents leakage of the jet material. Extending through the hollow-formed drive shaft 18 is a drive means (not shown) for operating the upper gripping part 5. The upper gripping part 5 consists essentially of two rods 20 lying in side-by-side relationship (FIG. 4), and they are connected together at their forward ends by a transverse member 21. These rods are journaled in the housing 17 at their driven end by a pivor axle 40. The upper gripping part 5 can be moved, therefore, upwardly and downwardly at a particular angle from the horizontal position shown in FIG. 3, whereby the upper position serves to introduce the casting into the tooth-type holder. From this position, the upper gripping part 5 then produces its tensioning forces against the casting.

The upper gripping part 5, as shown in this embodiment, is comprised of two tensioning beams 22 positioned one behind the other, and they are pendulously hung in bearings 24 from the shackles 23. The shackles in turn are fastened respectively to an arm 25 of the beam, which for its part is pendulously hung from the transverse piece 21 of the upper gripping part 5. The bearing 26 is common to the beam 25 as shown schematically in FIG. 4 and is provided with a rotary damper. The two beams 22, as can be seen in FIG. 3, have a toothed or, if necessary, stepped profile at the side facing the lower gripping part. While the axis of the bearing 24 of the tension beam 22 is positioned at an angle to the axis of rotation of the casting piece, the bearing axis of one of the common beams 25 extends transverse to this.

The lower fixed gripping part 4 has two flat metal plates 27 positioned on edge. These plates extend parallel to one another and are positioned on both sides of the axis of rotation of the casting piece holder at approximately the same distance. The tips at the forward end 28 are angled to one side as well as projecting in parallel relationship to one another.

The two rear supports 29, 30 are fastened to the metal plates positioned on end at an angle to the axis of rotation. At a distance therefrom and at the same angular positioning relative to the axis of rotation, two further supports, 31 and 32, are positioned in spaced relationship in the forward region of the lower gripping part 4. The positioning is so arranged that one support 30 of the rear pair of supports is formed as one piece with the support 31 of the other support pair lying on the opposite side of the rotational axis. The supports 29, 30, 31 and 32 are shown in FIG. 3 as being formed with teeth whereby the teeth 33 projecting upwardly terminate in blunt edges 34. The individual beams 22 on the upper gripping part 5 are positioned, meanwhile, between the supports 29, 30 or correspondingly 31, 32 on the lower gripping part and extend, as shown in FIG. 4, at the same angle to the axis of rotation of the tooth-type casting holder.

Further, with reference to FIG. 2, a vibrating device with a roller is provided in the region of the discharging station 11, and the tooth-type casting holder has a bearing surface adjacent to the roller by means of which the roller is rotated during the rotational movement of the casting holder on the roller. In the illustrated embodiment, the bearing surface is formed as a circular race 35, which is braced by struts 36 from the housing 17 and correspondingly the struts 37 from the lower gripping part. The diameter of the race is so dimensioned that the gripping parts are able to accomplish an opening movement unimpeded. The braces 36 as well as the plates 24 positioned on edge and forming part of the lower gripping part 4 are secured to the support plate 28 in this embodiment, and the support plate is connected, if need be, by means of a rotary damper 39 to the housing 17.

We claim:

1. A conveying device for castings in a casting cleaning apparatus comprising at least one tooth-type casting holder rotatable about an axis extending in a generally horizontal direction and having an upper and a lower gripping part of which the lower gripping part serves as a support for at least one casting, and the upper part serves as a tensioning member for tensioning the same casting, the lower gripping part (4) also being comprised of at least two supports (29,30) for at least one casting, and the supports holding the casting in an angular position relative to the axis of rotation of the holder.

2. A conveying apparatus according to claim 1 wherein the supports (29, 30) are bar shaped and are positioned with at least one support at each side of the axis of rotation and are oriented at an angle thereto.

3. A conveying apparatus according to claim 2, wherein the lower gripping part (4) is comprised of at least two further bar shaped supports (31, 32) which are arranged at the same angle and with approximately the same spacing from one another as the first two supports (29, 30), however, displaced at a distance from these supports at the free ends of the gripping part (4).

4. A conveying apparatus according to claim 3 wherein the one of the supports (30) of the first two supports (29, 30) that is positioned at one side of the rotational axis is formed as a single piece with the one of the supports (31) of the two further supports (31, 32) that is positioned on the other side of the axis of rotation.

5. A conveying apparatus according to claim 3 wherein each pair of supports (29, 30 or 31, 32) is arranged on the lower gripping part (4) opposite tensioning members on the upper gripping part (5), the tensioning members being formed as pendulously hung beams (22).

6. A conveying apparatus according to claim 5 wherein the two beams (22) are pendulously supported at the ends of a common beam (25) which in turn is pendulously suspended from the upper gripping part (5).

7. A conveying apparatus according to claim 1 wherein the upper gripping part (5) is comprised of a pendulously hung beam (22) through which the tensioning forces on the casting piece are transmitted in the tensioning position of the casting holder (3).

8. A conveying apparatus according to claim 5 wherein the pendulously hung beam (22) extends at an angle to the axis of rotation, the supports (29–32) on the lower gripping part (4) being bar-shaped and mounted at an angle relative to the axis of rotation corresponding to the angle of the beam.

9. A conveying apparatus according to claim 7 wherein the pendulously hung beam (22) of the upper gripping part is positioned approximately between the two supports on the lower gripping part.

10. A conveying apparatus according to claim 7 wherein a pivot bearing (26) supports the beam from the upper gripping part (5) and is vibrationally damped.

11. A conveying apparatus according to claim 1 wherein the supports (29, 30) and the tensioning members are formed with teeth at the sides for supporting the casting.

12. A conveying apparatus according to claim 11 wherein the tooth-type supports (29–32) and the tensioning member are comprised of teeth (33) which terminate in blunt edges (34).

13. A conveying apparatus in particular according to claim 1 for a casting cleaning apparatus which is comprised of a jet apparatus as well as at least one vibrator apparatus wherein the vibrating apparatus is comprised of a roller, and the tooth-type casting holder includes a rolling surface (35) by means of which the roller is rotated during the rotational movement of the casting.

14. A conveying apparatus according to claim 13 wherein the rolling surface is formed as a rotationally symmetric race (35) for rotational movement of the tooth-type casting holder (3).

15. A conveying apparatus according to claim 14 wherein the race (35) surrounds the gripping parts (4, 5) of the casting holder (3) in spaced relationship and is supported by struts (36) from the casting holder (3).

16. A conveying apparatus according to claim 14 wherein the lower gripping part is stationary and the upper gripping part performs the opening and tensioning movement exclusively and wherein further the race (35) is supported by struts (37) from the lower gripping part (4).

17. A conveying apparatus according to claim 16 wherein the lower gripping part (4) and the struts (36, 37) of the race (35) are secured to one common support plate (38) which is connected through the intermediary of a vibration damper (39) with the casting holder.

* * * * *